9/7/82 XR 4,347,801

United States Patent [19]

Colin

[11] 4,347,801

[45] Sep. 7, 1982

[54] BARGE AND TUG CONNECTION SYSTEM

[75] Inventor: Jean P. Colin, Metairie, La.

[73] Assignee: Bretagne ACB Corporation, New Orleans, La.

[21] Appl. No.: 116,616

[22] Filed: Jan. 29, 1980

[51] Int. Cl.[3] ..... B63B 21/60

[52] U.S. Cl. ..... 114/248; 114/253

[58] Field of Search ..... 114/248, 251, 247, 252, 114/253; 254/277, 326, 392; 280/479 R

[56] References Cited

U.S. PATENT DOCUMENTS

| | | | |
|---|---|---|---|
| 3,027,574 | 4/1962 | Meehan | 114/253 X |
| 3,735,722 | 5/1973 | Hooper et al. | 114/248 |
| 3,802,375 | 4/1974 | Janssen | 114/251 X |

FOREIGN PATENT DOCUMENTS

| | | | |
|---|---|---|---|
| 51788 | 10/1966 | Poland | 114/251 |
| 1148037 | 4/1969 | United Kingdom | 114/248 |

*Primary Examiner*—Sherman D. Basinger

*Attorney, Agent, or Firm*—Charles C. Garvey, Jr.

[57] ABSTRACT

A tug and v-notched barge connection apparatus provides an elastic rope which connects the tug and the v-notched barge together, the rope stretching during operation to allow relative movement between the barge and the tug. Each end portion of the rope attaches respectively to the stern of the barge and the stern of the tug. At the stern deck portion of the tug is provided a pair of hydraulically actuated pistons and (in the preferred embodiment) a pair of movably mounted levers. Each lever provides at its outboard end portion a hook which is adapted to attach to a provided eye at the tug end portion of the elastic rope.

35 Claims, 11 Drawing Figures

BARGE AND TUG CONNECTION SYSTEM

BACKGROUND OF THE INVENTION

1. Field of the Invention

The present invention relates to connection systems for Barge-Tug connections in which a tug pushes a notched barge. More particularly the present invention relates to a connection and tensioning device for the "pushing lines" which connect notched barges and tugs together preventing separation in adverse sea conditions while allowing relative movement between the tug and the barge and further allowing easy quick release of the pushing lines in emergencies without human intervention on deck.

2. General Background and Prior Art

It is well known in the marine art to secure the tug in the notch of the barge by using pushing lines. Most of the systems in present use look similar.

One end of a heavy cable, generally a wire rope, is secured with a shackle to the transom of the barge on each side. The other end of this cable, called the pushing line, runs over a large sheave pinned on the aft deck of the tug, close to the bulwark, and is then secured either to the deck of the ship or the towing winch, sometimes through some kind of device giving some elasticity to the assembly.

Generally all systems are built on these present principles and differ only by their components. Most of these prior art systems have the same drawbacks. The pushing lines at sea are taut and slack alternatively, due to relative motions of the tug and barge, and snap by snatching when the sea deteriorates. The handling of those lines is very clumsy and there is generally no safe emergency release system.

Those systems of the prior art, although in use for many years, have not been greatly improved since the tugs were pushing only in relatively good weather.

The sizes of tugs and barges are now increasing sensibly as well as the necessity to keep on pushing in adverse conditions. Some recent technological improvements on the fender system of the tug allow the tug to stay in the barge up to fifteen (15) foot seas and there is a demand for improved pushing lines. An increase in the size of the actual system becomes a problem in that large systems are impossible to handle by the crew members and too expensive.

GENERAL DISCUSSION OF THE PRESENT INVENTION

The present invention solves the prior art problem and shortcomings by providing a connection and tensioning device which allows relative movement between the tug and the barge in adverse sea conditions with a snapping of the pushing line being prevented. Further, the system of the present invention provides a reduced stress on the aft deck of the tug, consequently reducing the price of the tug. The present invention further provides a fast, efficient and safe emergency release system which can be operated without personnel on deck. The present invention also provides an apparatus which facilitates easy connection of the pushing lines and avoids the handling during connection of the pushing apparatus by deck hands.

The present invention provides a barge and tug connection apparatus with a barge having a v-notched portion connecting to a tug, the tug allowed to pitch and heave within the barge notch. At least one elongated elastic pushing line having barge and tug end portions is provided, with connections being perfected at the respective end portions to the barge and to the tug. A pre-stressing member mounted in the preferred embodiment on the tug stretches the pushing line uniformly along its length between the tug and the barge, the pushing line being unidirectional and being entirely disposed during operation between the tug and the barge, at the end connection portions.

A quick release system allows quick disconnect in for example emergency situations.

The prestressing member can be a powered lever movably attached to the tug aft deck (see FIGS. 4 and 6). The pushing line lever connection can be a hook and eyelet connection with the lever providing a hook and the pushing line having an eyelet. Other suitable temporary connections such as a claw/ball or removable pin could be used.

The quick release system in the preferred embodiment is a slot in the tug bulwark, with the lever moving through the slot effecting a disengagement with the larger eyelet, the eyelet being unable to push through the slot.

The lever could be powered for example hydraulically by using a hydraulic cylinder affixed to the lever and to the tug deck. An alternate embodiment provides a movable powered carriage with an outboard projecting hook (see FIG. 7), while still another embodiment provides the hook portion directly affixed to the hydraulically powered cylinder (see FIGS. 10–11).

It's thus an object of the present invention to provide a v-notched barge and tug connection system allowing relative movement between the barge and tug, even in heavy seas.

It is another object of the present invention to provide a v-notched barge and tug connection system which reduces stresses transmitted to the pushing rig.

Another object of the present invention is to provide a v-notched barge and tug connection system wherein the connection is safely made without direct human intervention in the vicinity of the stressed pushing lines.

Another object of the present invention is to provide a v-notched barge and tug connection system which is quickly, easily, and safely disengaged during, for example, emergency situations.

Still another object of the present invention is to provide a v-notched barge and tug connection system which eliminates the chance of pushing lines becoming slack during the pushing operation, even during excessive relative movement between the barge and tug as occurs in heavy seas.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
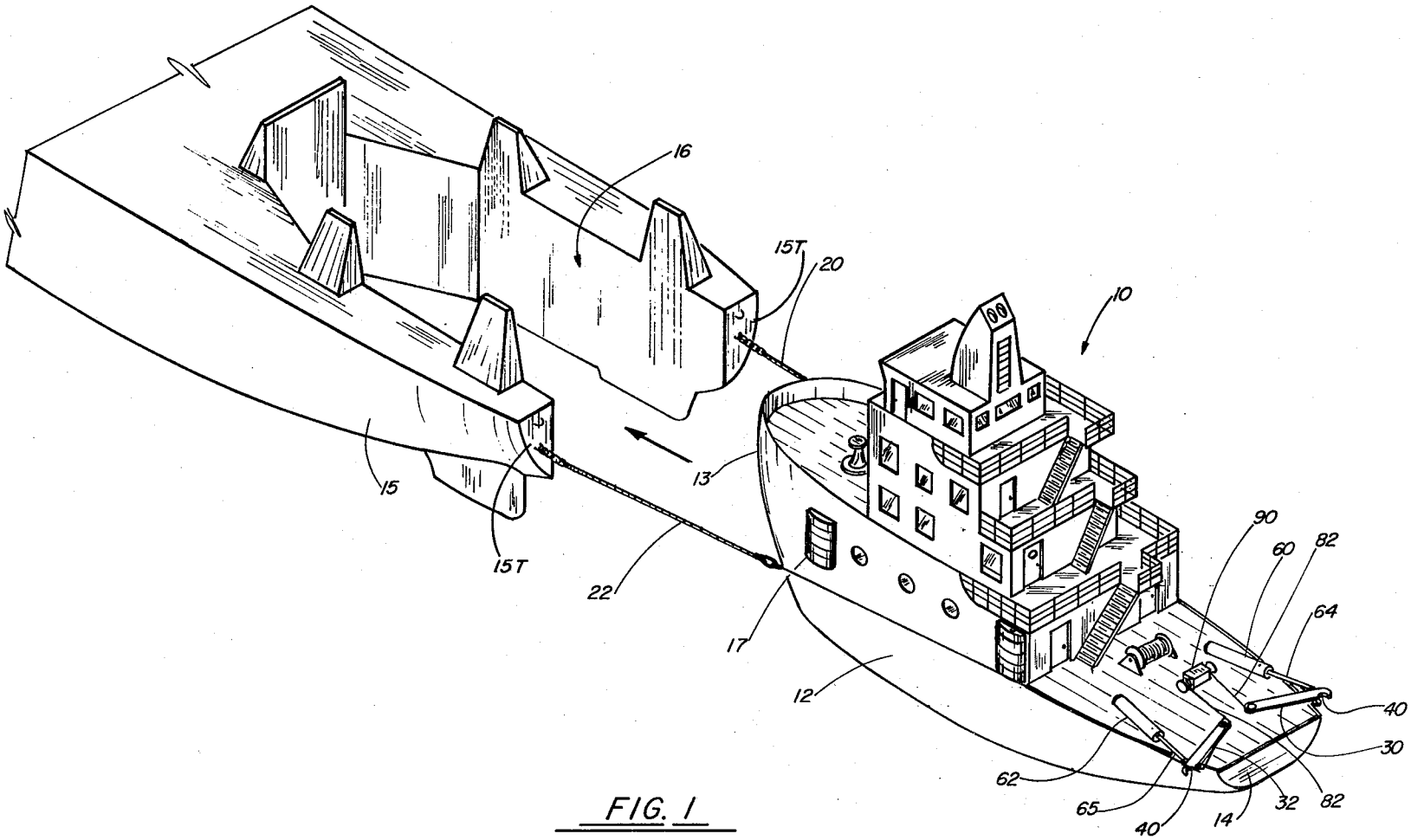
FIG. 1 is a perspective view of the preferred embodiment of the apparatus of the present invention.
Figure 10:
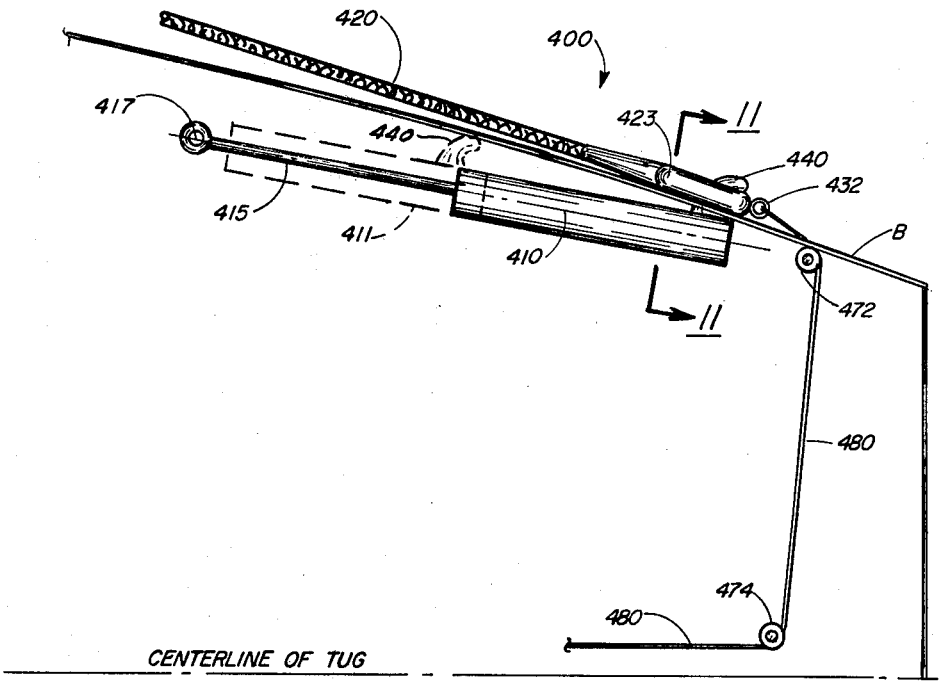
FIG. 10 is a top view of a third alternative embodiment of the apparatus of the present invention.

FIG. 1 best illustrates the preferred embodiment of the apparatus of the present invention designated generally by the numeral 10. In FIG. 10 there can be seen a typical v-notched barge 15 having a recess 16 portion adapted to receive a tug 12 thereinto at least partially. During operation, tug 12 may move upwardly and downwardly with respect to Barge 15 within recess 16. Recess 16 thus has no bottom or other protruding structure which would prevent such generally vertical relative movement by tug 12 within recess 16.

In FIG. 1, tug 12 provides bow 13 and stern 15 portions with inflatable pads 17 being provided on the sides of the tug 12 hull. A pair of pushing lines 20, 22 are schematically shown as connecting barge 15 and tug 12. Note that each line 20, 22 attaches between the stern portions of tug 12 and the transom 15T of barge 15 respectively.

At the stern 14 portion of tug 12 there is seen a pair of hydraulically operated pistons 60, 62 which can be movably mounted (for example, pivotally) to tug 12 at the deck portion thereof. Each piston 60, 62 provides push rods 64, 65 which actuate levers 30, 32. Each lever 30, 32 provides an outboard hook 40 portion which attached during operation to a provided eyelet at the tug end portion of pushing lines 20, 22. The construction of each hook 40 will be described more fully hereinafter as well as the operative relationship with pushing lines 20, 22.

Figure 2:
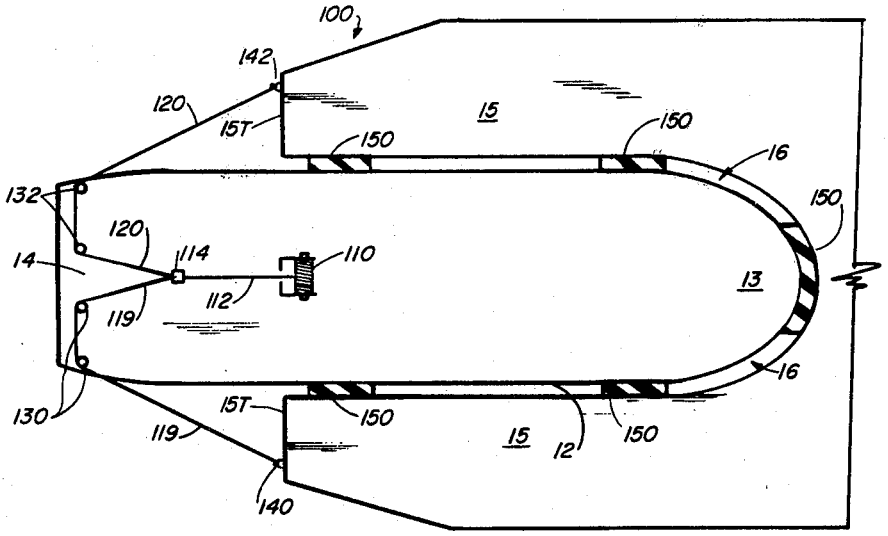
PRIOR ART FIG. 2
FIG. 2 is a typical prior art type v-notched barge and tug connection using wire rope and sheaves.
Figure 3:
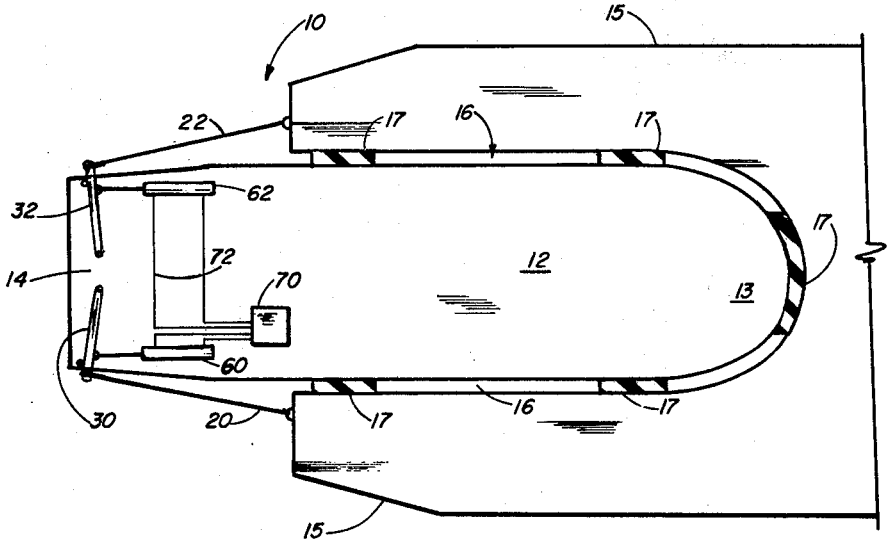
FIG. 3 is a top view of the preferred embodiment of the apparatus of the present invention.

In FIGS. 2 and 3 there is seen respectively a prior art type (FIG. 2) v-notched barge and tug connection as well as the v-notched barge and tug connection of the present invention (FIG. 3).

In FIG. 2 prior art type connection 100 provides a connection between tug and v-notched barge 15. A plurality of cushion members 150 are provided between tug 12 and barge 15. At the transom 15T portion of barge 15 there is provided a pair of attachments 140, 142 for attaching metal wire lines 119, 120 thereto. Sheaves 130, 132 are provided at the stern 14 portion of tug 12 which sheaves change the direction of wire ropes 119, 120 directing them toward bridle 114 and then to pull line 112 and winch 110. Pull line 112 can be provided with some elasticity but it should be understood that the connection of the prior art as shown in FIG. 2 does not provide for large amounts of relative motion between tug 12 and barge 15 as is the case in heavy seas. It should also be understood by an inspection of FIG. 2, that the resultant forces on the structures of the aft portion of the tug's deck is doubled because of the change in direction required to pass ropes 119, 120 through sheaves 130, 132 and then toward winch 110. It is one object of the present invention to provide a single direction line which cuts in half the resultant forces which act on the tug's structure during operation.

FIG. 3 shows a top view of the preferred embodiment of the apparatus of the present invention. In the top view of FIG. 3 there can be seen hydraulically actuated piston 60, 62 which will be provided with a hydraulic actuating system 70 which connects each piston 60, 62 through hydraulic lines 72 to system 70.

Figure 4:
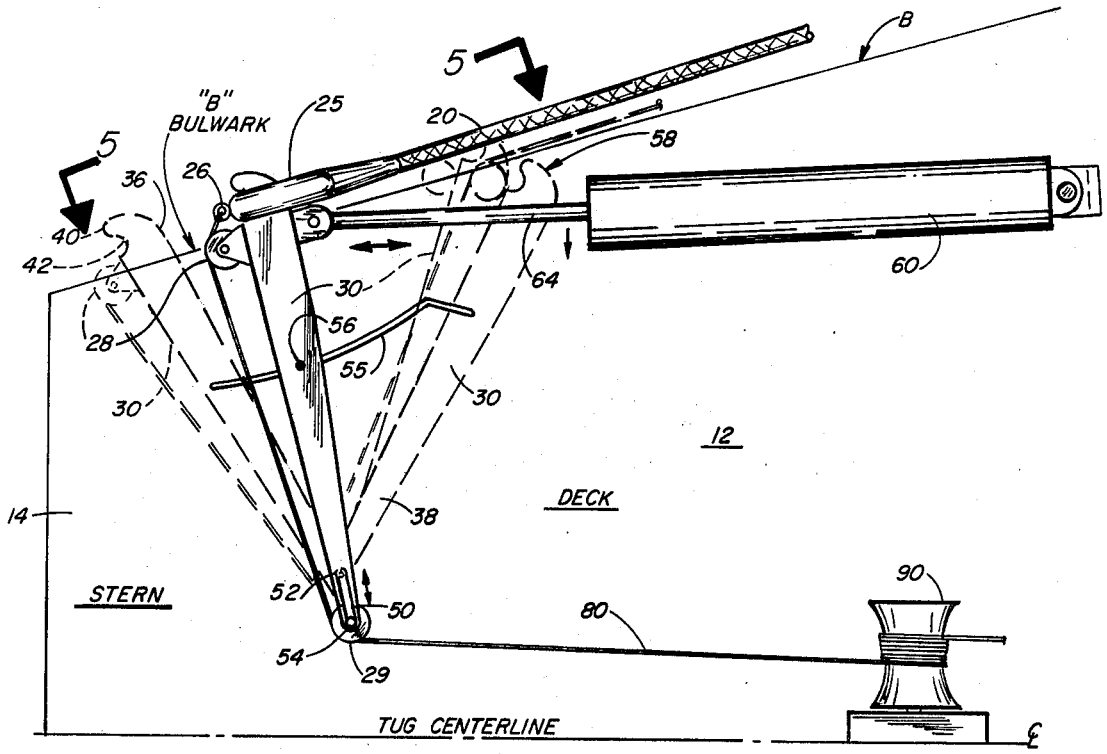
FIG. 4 is a top detailed view of the preferred embodiment of the apparatus of the present invention illustrating one embodiment of the lever and hydraulic cylinder portions thereof.

FIG. 4 illustrates more particularly the construction of lever 30 and its attachment to the deck portion of the tug 12 as schematically illustrated in FIG. 4 in the preferred embodiment.

The stern, aft deck, and bulwark portions of tug 12 are schematically illustrated in FIG. 4. Lever 30 provides outboard 36 and inboard 38 portions. At the inboard 38 portion of lever 30, there is seen track 50. A pin or roller will be provided at the inboard 38 portion of lever 30 adapting lever 30 at end portion 38 for travel in track 50. As shown by the phantom lines in FIG. 4 representing various positions of lever 30 during operation, the end portion 38 of lever 30 will move from one end portion 52 to the opposite end portion 54 of track 50 during operation.

A second track 55 corresponds with a provided pin 56 of lever 30. Track 55 is provided to cooperate with track 50 to move the hook 40 portion of lever 30 in a path generally parallel with the bulwark "B" portion of tug 12, for most of the lever stroke.

When lever 30 is moved astern to its fullest extent, hook 40 will be exposed as shown in FIG. 4 in phantom lines. However, when lever 30 is moved to its forward most position indicated by the numeral 58 in FIG. 4, hook 40 will be withdrawn within the confines of the tug deck and inside bulwark "B." It should be understood that in this position, pushing line 20 and lever 30 will become disconnected with pushing eyelet 25 disengaging from hook 40. A provided slot 28 in bulwark "B" provides a width w-1 (FIG. 5) smaller than the overall height w-2 of eyelet 25. From the above, it can be seen that when hook 40 is withdrawn within the confines of deck 20, eyelet 25 will strike bulwark "B" and become disengaged from lever 30 as hook 40 passes through slot 28.

In FIG. 4 a messenger line is provided which is designated by the numeral 80. Messenger line 80 as will be described more fully hereinafter is used to pull line 20 toward hook 40 and attach specifically eyelet 25 to recess 42 of hook 40. Note that eyelet 25 provides a ring 26 to which the end portion of messenger line 80 is attached. At the end portions of lever 30 is provided a first sheave 28 and a second sheave 29 across which messenger line 80 is threadably engaged before its attachment to winch 90. During operation, tow line 80 will first be extended and attached by a deck hand on the barge to eyelet 25 at ring 26. Rotational power applied to winch 90 will then pull and take in messenger line 80 moving eyelet 25 toward hook 40 and recess 42. Once fully taken in messenger line 80 will register line 25 upon hook 40 at recess 42 which position is shown best in FIGS. 1, 3, 4 and 5. In this position, lever 30 is ready for its hydraulic actuation which will prestress and will preload pushing lines 20, 22 as is desirable.

Figure 6:
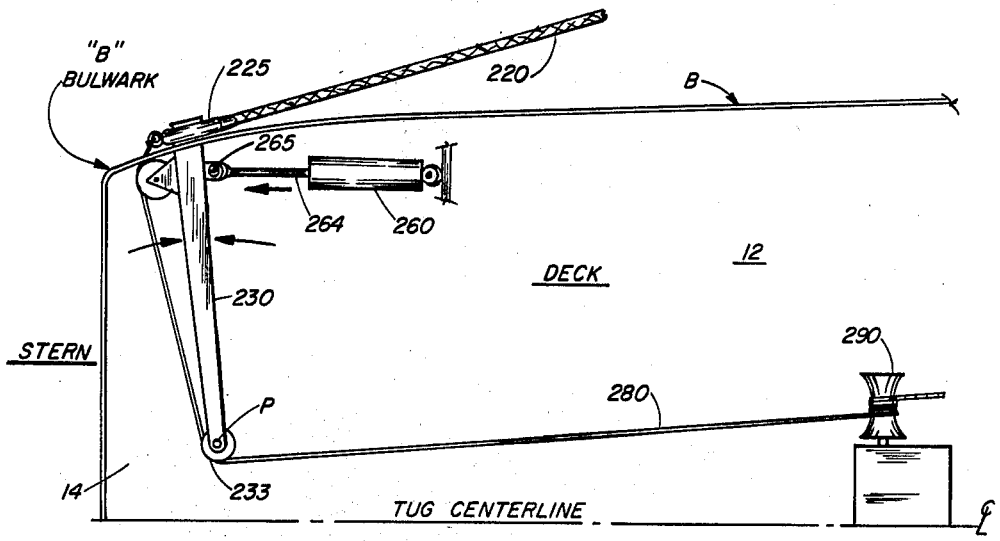
FIG. 6 is a top detailed view of an alternative embodiment of the apparatus of the present invention illustrating an alternative construction of the lever portion thereof.

In FIG. 6 there is seen an alternative embodiment of the present invention. In FIG. 6 lever 230 is pivotally mounted above pivot "P" and does not travel in a pair of tracks 50, 55 as with the preferred embodiment of FIG. 4. This construction will provide a purely pivotally mounted lever 230 with the end portion travelling in a circular path rather than parallel to the side of bulwark "B". Piston 260 is provided for movably actuating lever 230 by means of push rod 264 which is attached thereto at connection 265. The construction and operation of lever 230 and the pushing line 220 and eyelet 225 to lever 230 is substantially identical to the embodiment of FIG. 4.

Figure 8:
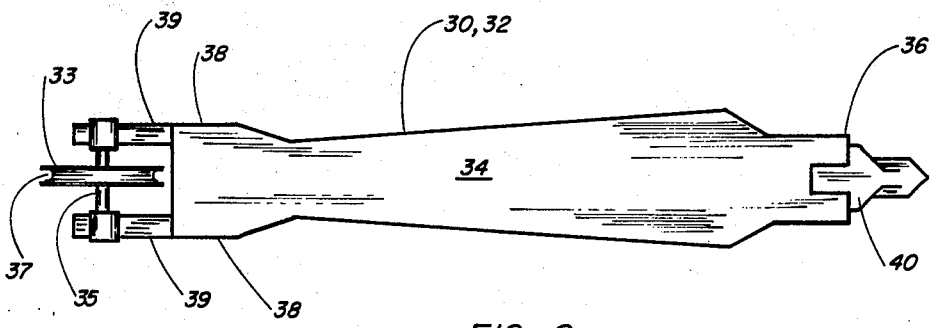
FIGS. 8 and 9 are side and top views respectively of the lever portion of the preferred embodiment of the present invention.
Figure 9:
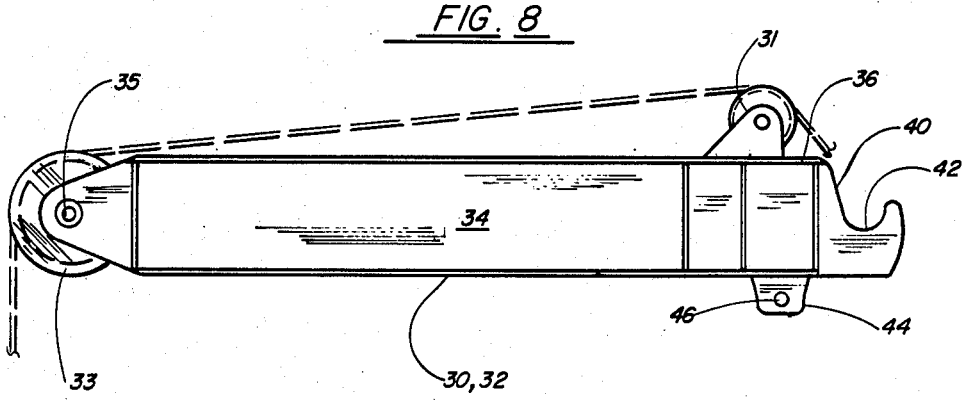

The construction of lever 30 is best seen in FIGS. 8 and 9. Levers 30, 32 peovide outboard 36 and inboard 38 portions with hook 40 having recess 42 being attached at outboard 36 portion. Also provided at the outboard portion of lever 30, 32 is roller 28 and pulley 31 portions. Push rod 64 attaches at pulley 31 to lever 30 as best seen in FIG. 4.

Figure 7:
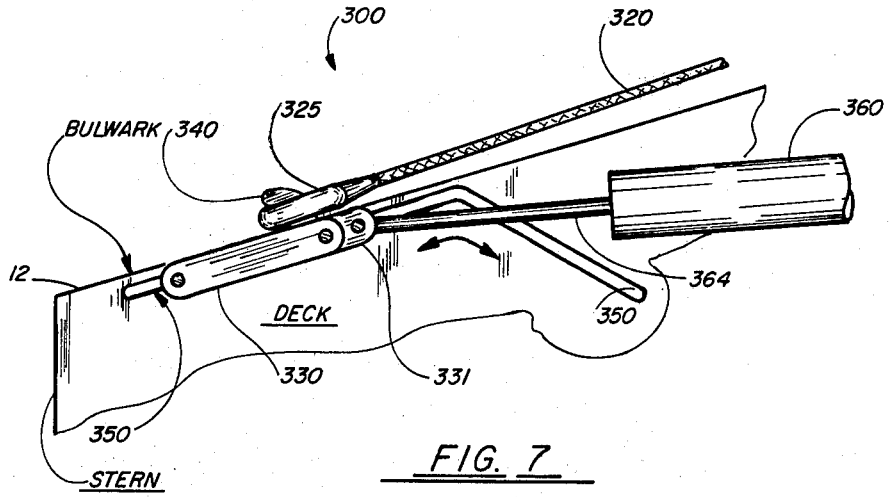
FIG. 7 is a top view of a second alternative embodiment of the apparatus of the present invention.

An alternative embodiment of the apparatus of the present invention as seen in FIG. 7 being a second alternative thereof. In the second alternative embodiment of FIG. 7 there is provided an apparatus 300 having carriage 330, which is movably mounted within curved track 350, the forward end portion of the carriage 330 having a yoke attached to the push rod 364 of piston 360. Hook 340 portion of carriage 330 provides an attachment for eyelet 325 of pull line 320. The operation of apparatus 300 is similar to that shown in the embodiments of FIGS. 4 and 5 in that piston 360 will urge push rod 364 astern as shown by the arrow in FIG. 7 preloading pull line 320 to a desired tension.

Figure 5:
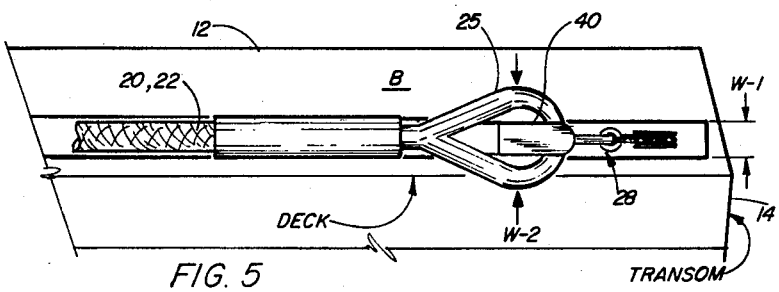
FIG. 5 is a side view of the preferred embodiment of the apparatus of the present invention illustrating the elastic rope, eyelet and lever portions thereof.

To disengage eyelet 325 and hook 340, hydraulic pressure to piston 360 is applied on the rod side of cylinder 360. The forward end of track 350 is inwardly directed as shown, and carriage 330 moves forwardly and curved track 350 directs carriage 330 inwardly disengaging the eyelet 325 from the hook 340, as the said hook moves inward through a slot in the bulwark (similar to slot 28 as shown in FIG. 5).

In emergency the pushing lines 20, 22 can be released without the need to apply the hydraulic pressure on the rod side of the cylinders. By releasing the pressure on the bottom side of the cylinders and rotating the tug's propeller astern, the thrust of the propeller is sufficient to retract the cylinder and break a shear pin which attaches the messenger line 80 to the ring 26 of the eyelet 25 on each side of the tug.

Figure 11:
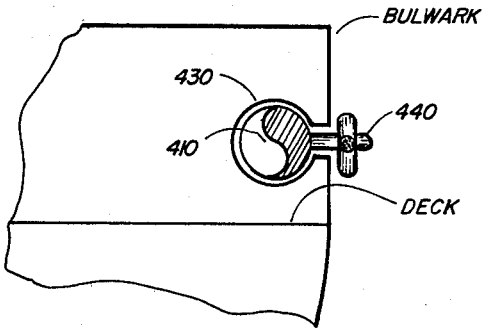
FIG. 11 is a section view taken along lines 11—11 of FIG. 10.

FIGS. 10 and 11 shows a third alternative embodiment of the apparatus of the present invention designated generally by the numeral 400. Schematically shown in FIG. 10 is a top view of a side portion of the tug 12 showing bulwark B. Tug 12 would be similar in construction to the tug of FIGS. 1, 3, 5, 4, 6 and 7.

Pushing line 420 is shown as equipped with a suitable eyelet 423 which is adapted to register with and attached to hook 440. Hook 440 in the embodiment of FIG. 10 is attached directly to cylinder 410 which is operable by means of hydraulic power. Pushrod 415 attaches to cylinder 410 and at its opposite end portion is pivotally attached or pinned at pivot 417 to the deck portion of the tug.

A longitudinally slotted tube 430 could be provided as attached to the deck or bulwark portion of the tug as shown in FIG. 11 with cylinder 410 being slidably mounted within tube 430 and hook 440 portion projecting outwardly for attachment to eyelet 423. Eyelet 423 would be in other respects constructed as is the case with respect to the embodiment of FIG. 5, having ring 432 attached to messenger line 480, with guide sheaves 472, 474 directing messenger line 480 to a suitable winch (See for example, FIGS. 4 and 6).

During operation, cylinder 410 would move with 440 being directly mounted thereto. Tube 430 would be installed angularly with respect to bulwark "B" so that hook 440 would move inwardly of bulwark "B" as shown in phantom lines in FIG. 10 when cylinder 410 assumed a forward and innermost position with respect to pivot pin 417. In this manner, eyelet 423 would be disengaged from hook 440 when cylinder 410 moved forwardly. Such disengagement could be achieved as was earlier described with respect to the previous embodiments when hydraulic pressure supplied to cylinder 410 was removed and the tug propeller reversed to back the tug out of the v-notched portion of the barge. Ring 432 which would be a shear-pin type affair, would rupture allowing eyelet 423 to be freely disengaged from hook 440 and thus tug 12 disengaged from its connection with the v-notched barge to which it was attached.

What is claimed as invention is:

1. A barge and tug connection apparatus comprising:

a. a barge providing a V-notched portion for receiving a tug into said V-notch;

b. a tug for pushing said barge with said notch allowing said tug to pitch and heave in said notch relative to said barge;

c. a least one elongated elastic pushing line, said pushing line terminating at barge and tug end portions which define its length, said pushing line stretching during operation responsive to relative movement between said tug and said barge;

d. tug connection means associated with said tug and separate from said pushing line for connecting the tug end portion of said pushing line to said tug, said pushing line being disposed during operation between said barge and said tug connection means, said tug connection means comprising at least in part moving means movably mounted on said tug between aft connected and fore disconnected positions, for forming a connection with the tug end portion of said pushing line, said moving means being generally aft of said disconnected position when in said connected position;

f. release means for separating said pushing line from said moving means responsive to movement of said moving means from said aft connected position to said fore disconnected position;

g. pre-stressing means associated with said connection means for pre-stressing said pushing line uniformly along its length between said barge and said tug connection means, with said pushing line being stressed continuously during operation by said pre-stressing means disallowing a slackening of said pushing line.

2. The apparatus of claim 1 wherein said pre-stressing means comprises at least in part a pre-stressing member being movably mounted on said tug, said pre-stressing member providing an outboard connection portion for engaging at least temporarily the tug end portion of said elongated elastic pushing line.

3. The apparatus of claim 1 wherein said tug connection means comprises at least in part an eyelet provided on said tug end portion of the said elongated elastic pushing line and a hook member mounted on said prestressing means, said hook member engaging at least in operation said eyelet.

4. The apparatus of claim 3 wherein the tug provides a bulwark portion and said hook member is movably mounted with respect to said tug and defines a path which at least partially follows the bulwark portion of said tug, said path tracking said hook between fore and aft positions.

5. The apparatus of claim 1 wherein said tug connection means comprises:

(a) a tension arm member movably mounted on said tug;

(b) temporary attachment means on said tension arm member for engaging said tug end portion of said pushing line, said attachment means being movable with said arm between fore and aft positions.

6. The apparatus of claim 5 further comprising quick release means associated with said temporary attachment means for disengaging said attachment means from said tug end portion of said pushing line.

7. The apparatus of claim 6 wherein said quick release means comprises at least in part slot means on said tug, and said temporary attachment means moves on a path which passes said temporary attachment means from the outboard side of said slot means to the inboard side thereof, said attachment means releasing the connection between said attachment means and said pushing line when said attachment means moves through said slot means to the inboard portion thereof.

8. A barge and tug connection system comprising:

a. a tug having an aft deck surrounded by a bulwark;

b. a barge providing a V-notch, said V-notch allowing said tug to pitch and heave within said V-notch relative to said barge in heavy seas;

c. at least one elongated pushing line having a tug end portion and a barge end portion;

d. a tension arm member movably mounted on said aft deck of said tug between fore, inboard and aft, outboard positions;

e. cylinder means associated with said tension arm member for powering said tension arm member at least from said fore inboard position to said aft outboard position;

f. hook means on said tension arm member for attaching said tug end portion of said pushing line to said tension arm member at said aft, outboard position of said tension arm; and g. quick release means associated during operation with said pushing line for quickly releasing the connection between said pushing line and said tension arm member responsive to movement of said arm from said aft to said fore position.

9. The apparatus of claim 8, wherein said quick release means comprises at least in part a slot formed in said bulwark of said tug, and said tension arm member passes at least in part through said slot during movement between fore and aft positions, and said hook means disengages said tug end portion of said pushing line when said hook moves from said aft to said fore position, passing through said slot to said aft deck.

10. The apparatus of claim 8 wherein said cylinder means is a hydraulic powered cylinder having a push rod portion, said push rod portion being connected to said tension arm member and said push rod and said arm moving responsive to the introduction of pressurized hydraulic fluid into said hydraulic cylinder.

11. The apparatus of claim 8 wherein said tension arm member is a lever arm having an outboard hook facing aft, said hook being capable of forming a temporary attachment with said tug end portion of the pushing line.

12. The apparatus of claim 8 wherein said hook means is an aft facing hook provided on said tension arm member.

13. The apparatus of claim 8 wherein said tension arm member is a lever arm pivotally mounted on said tug.

14. The apparatus of claim 8 wherein there is a further provided track means on said tug for supportedly guiding said tension arm member between fore and aft positions.

15. The apparatus of claim 14 wherein said track means guides said tension arm member between fore and aft positions, with said tension arm member passing inboard of said bulwark portion of said tug when said tension arm member is in an extreme fore position on said track means.

16. The apparatus of claim 15 further comprising an eyelet provided at the tug end portion of the pushing line, and said tension arm member provides an aft facing hook portion, and said hook portion moves between fore and aft positions, with said hook portion withdrawing through a slot provided in said bulwark of said tug when said hook means assumes a fore position on said track means, and said eyelet is larger than said slot provided in said bulwark, with said eyelet disengaging from said hook when said hook passes from an outboard position through said slot to an inboard forward position on said track means.

17. The apparatus of claim 16 further comprising messenger line means for preliminarily engaging said eyelet of said pushing line with said hook provided on said tension arm member.

18. A barge and tug connection apparatus comprising:

a. a tug adapted for pushing a barge, said tug providing at least an aft deck portion and a bulwark portion;

b. a barge providing a V-notched portion in which said tug can register, said tug being freely movable within said notch in a vertical direction, allowing said tug to pitch and heave within said notch;

c. at least one pushing line, said pushing line being substantially elastic along its entire length, said pushing line terminating at said tug end portion and a barge end portion thereof which define its length;

d. releasable attachment means movably mounted on said tug and separate from said pushing line for prestressing said pushing line, said attachment means forming a connection with said tug end portion of said pushing line in an aft connection position outboard said bulwark during the pushing of said barge by said tug;

e. cylinder means associated with said attachment means for powering said attachment means between said aft connection position, outboard said bulwark to a fore release position inboard said bulwark with a disconnection occurring responsive to movement of said attachment means from said aft to said fore position.

19. The apparatus of claim 18 further comprising track means associated with said attachment means for defining a path of movement for said attachment means between said fore and aft positions.

20. The apparatus of claim 19 wherein said attachment means passes at least in part through a slot provided on said bulwark when said lever arm moves between fore and aft positions.

21. The apparatus of claim 18 wherein said attachment means comprises in part a hook provided on the outboard portion of said attachment means, and said pushing line provides an eyelet at the tug end portion thereof, said eyelet registering and connecting to said hook during operation.

22. The apparatus of claim 21 wherein there is further provided a slot in said bulwark, and said hook moves through said slot between inboard and outboard positions as said attachment means moves between fore and aft positions on said tug aft deck.

23. The apparatus of claim 21 wherein there is provided a slot in said bulwark of said tug through which said hook passes during operation, said hook being outboard of said bulwark at the aft portion of the movement of said attachment means, and being inboard of said slot and said bulwark at said fore position.

24. The apparatus of claim 23 wherein said slot is of a thickness which allows said hook to pass freely therethrough, and said eyelet is larger in diameter than said slot, whereby said eyelet is prevented from passing through said slot with said hook when said hook moves inboard through said slot and said bulwark, the movement of said hook, when attached to said eyelet, through said slot effecting a release of said pushing line from its connection to said tug.

25. The apparatus of claim 18 wherein said cylinder means comprises a hydraulic cylinder movably mounted on the aft deck portion of said tug, and said hydraulic cylinder is connectable to a source of pressurized hydraulic fluid for powering said cylinder.

26. The apparatus of claim 18 wherein said attachment means is a lever arm movably attached to the aft deck portion of said tug and attached to the outboard end portion of said lever arm is an extendable hydraulic powered cylinder, said cylinder being attached at one end portion to said deck and at the opposite end portion to said lever arm, with an extension of said cylinder moving said lever arm from a fore to an aft position.

27. A barge and tug connection apparatus comprising:

a. a tug providing an aft deck and a bulwark portion surrounding said aft deck with a longitudinal slot being formed in a portion of said bulwark;

b. a V-notched barge, said barge providing a V-notched portion for connectedly receiving said tug thereinto, said V-notched portion allowing vertical movement of said tug within said V-notch;

c. at least one lever arm movably mounted on said aft deck;

d. an extendable hydraulic cylinder mounted on said deck and being movable between recessed and extended positions;

e. a source of pressurized hydraulic fluid connectable to said cylinder for powering said cylinder from said recessed to said extended position;

f. an aft facing hook attached to the outboard end portion of said lever arm, said hook having a thickness smaller than the thickness of said slot and being capable of freely passing through said slot during operation;

g. at least one elastic pushing line having a barge end portion and a tug end portion with an eyelet attached to said tug end portion, said eyelet and hook forming a releasable temporary connection with said hook and being larger than said slot, with said hook and said eyelet disengaging whenever said hook moves over said aft deck passing through said slot.

28. A method of attaching a v-notched barge and pushing tug together for pushing comprising the steps of:

a. placing the pushing tug bow portion into the barge v-notch portion;

b. providing at least one elastic pushing line terminating at barge and tug end portions which define its length;

c. providing at least one powered lever arm movably mounted on the tug with the arm having an attachment end portion which travels responsive to movement of the arm between a first attachment position and a second release position forward thereof;

d. affixing the barge end portion of the pushing line to the barge;

e. affixing the tug end portion of the pushing line to the tug at the attachment end portion of the lever arm;

f. pre-stressing the pushing line to remove any slackness when the tug and barge are together;

g. pushing the barge with the tug allowing stretching of the pre-stressed elastic pushing line responsive to relative motion between the tug and the barge during the pushing operation; and h. automatically releasing the connection by moving the lever arm from the attachment position to the release position.

29. The method of claim 28 wherein the lever provides an outboard hook and the pushing line tug end portion provides an eyelet attachable to the hook, and aftward movement of the lever lengthens the pushing line pre-stressing it.

30. The method of claim 28 wherein in Step "b" a pair of pushing lines are provided.

31. The method of claim 30 wherein one of the pushing lines is attached between the port side of the barge and tug and the second pushing line attaches between the starboard sides of the barge and tug.

32. The method of claim 28 wherein in Step "b" a non-metallic pushing line is provided.

33. The method of claim 28 wherein the powered lever arm is hydraulically powered.

34. The method of claim 28 wherein in Step "g", the elastic pushing line is stretched substantially along its entire length.

35. A barge and tug connection apparatus comprising:

a. a barge providing a V-notched portion for receiving a tug into said V-notch;

b. a tug for pushing said barge at said notch;

c. at least one powered lever arm movably mounted on said tug, said arm having an attachment end portion which travels responsive to movement of said arm between a first attachment position and a second release position generally forward of said first attachment position;

d. at least one elastic pushing line having a length defined by barge and tug end portions, said barge end portion being connected to said barge and said tug end portion being releasably connectable to said lever arm at said attachment end portion at least when said attachment end portion is at said first attachment position; and e. release means on said tug, and generally on the path defined by movement of said attachment end portion of said lever from said first attachment position to said second release position for disconnecting said pushing line from said tug responsive to movement of said attachment end portion of said lever from said first to said second position.

* * * * *